United States Patent [19]

Bird

[11] 4,433,033

[45] Feb. 21, 1984

[54] INDUSTRIAL METALS COATED WITH AWARUITE-LIKE SYNTHETIC NICKEL/IRON ALLOYS

[76] Inventor: John M. Bird, 1187 Ellis Hollow Rd., Ithaca, N.Y. 14850

[21] Appl. No.: 412,700

[22] Filed: Aug. 30, 1982

[51] Int. Cl.[3] ..... C23C 1/00; C23C 5/00; C23C 7/00

[52] U.S. Cl. ..... 428/682; 428/680; 428/681

[58] Field of Search ..... 428/682, 680; 252/626, 252/633; 250/507.1

[56] References Cited

U.S. PATENT DOCUMENTS

| | | | |
|---|---|---|---|
| 1,547,395 | 7/1925 | Hoyt | 428/682 |
| 1,762,730 | 6/1930 | McKeehan | 428/928 |
| 3,966,425 | 6/1976 | Takeo | 428/680 |
| 4,075,392 | 2/1978 | Jaeger | 428/682 |
| 4,192,765 | 3/1980 | Bird | 250/507.1 |
| 4,337,167 | 6/1982 | Bird | 252/633 |

OTHER PUBLICATIONS

J. M. Bird et al., Science, 206, pp. 832–834, 1979.

J. M. Bird et al. Geochemical Journal, 13, pp. 41–45, 1979.

E. Josso, Eomptes Rendus, 230, pp. 1467–1469, 1950.

A. H. Geisler, Trans Am. Soc. Metals, 45, pp. 1051–1054, 1953.

*Primary Examiner*—Veronica O'Keefe

[57] ABSTRACT

A corrosion resistant synthetic iron-nickel alloy is prepared having the composition of the mineral awaruite. It is employed as a corrosion resistant coating on industrial metals. Articles of manufacture having high resistance to corrosion can be fabricated from the synthetic nickel-iron alloy per se or from industrial ferrous metals coated with said alloy.

25 Claims, 3 Drawing Figures

LEGEND

○ γ' ONE PHASE REGION
◉ γ + γ TWO PHASE REGION
○ α + γ' & γ' EQUILIBRIUM BOUNDARY
} CARBONYL TECHNIQUE DATA OF HEUMANN & KARSTEN (1963)

• γ + γ' BOUNDARIES FROM GEISLER'S (1953) INTERPRETATION OF JOSSO'S (1950) DILATOMETRIC DATA

—— = PHASE BOUNDARIES OF HEUMANN & KARSTEN (1963)
- - - = PHASE BOUNDARIES OF YITING (1957)

LEGEND

○ ELECTRIC RESISTANCE

◉ MICROSTRUCTURES

● DIFFERENTIAL THERMAL ANALYSIS

LEGEND

— — — — EXTRAPOLATIONS OF PHASE BOUNDARIES

— · — — · — METASTABLE EXTENSIONS

△ COMPOSITION OF ALLOYS FOR CORROSION TESTS

H RANGE OF COMPOSITIONS OF SINGLE PHASE ALLOYS KNOWN TO HAVE THE γ' STRUCTURE

INDUSTRIAL METALS COATED WITH AWARUITE-LIKE SYNTHETIC NICKEL/IRON ALLOYS

BACKGROUND OF THE INVENTION

Industrial metals, especially the industrial ferrous metals, are used in a great variety of applications in natural environments, such as pipes, bridges, ships, towers, oil and gas drilling rigs, marine piping and valves, rock mining equipment, electrical facilities, and pipe lines for the transport of fluids and slurries. Corrosion protection for ferrous metals used in various natural and artificial environments is provided by coatings such as paints, wrappings and galvanizings, and metal laminations. There are many patents and literature articles directed to the prevention of corrosion of ferrous metals. There are many ferrous alloy formulations known as stainless steels that are corrosion resistant. However, stainless steel is expensive and coatings of paint, plastics, hydrocarbons and galvanizings are not permanent, especially in corrosive geochemical environments such as marine environments and various underground environments within soil and rock. It is common knowledge that the ferrous metal members of bridges, for example, have to be protected from corrosion, usually by galvanizing or painting. Components of ships require constant attention by painting to retard corrosion of the metal by sea-water.

It is generally understood and accepted that ferrous metals and alloys thereof will become corroded and decomposed by rusting within several to tens of years when exposed to the weather, or used in marine and underground applications, or used in corrosive enviroments such as boilers and heat exchangers. Many various coatings used to retard corrosion of ferrous metals are themselves unstable in natural environments.

Awaruite is the mineral name for naturally occurring iron-nickel alloys having the $\gamma'$ (gamma-prime) structure. The most common composition of awaruite corresponds to the formula $FeNi_3$ which is that of an ordered, stoichiometric phase. Awaruite may contain small amounts of copper and cobalt metal, e.g., less than about 5 atomic percent each. It is formed in nature during the hydrothermal alteration of ultramafic rock (serpentinization) at temperatures around 300°–400° centigrade. Awaruite is known both as a mineral component of altered ultramafic rocks and as detrital grains in sediments produced by the erosion of altered ultramafic rocks. In both examples it has been shown that the awaruite has survived for thousands to millions of years. Awaruite is stable over wide ranges of Eh, pH, temperature, pressure and varying compositions of groundwater. Awaruite is stable in groundwater containing substantial amounts of chloride ions, oxygen and other solutes in natural geochemical environments.

The ranges of compositions and temperatures within which alloys of iron and nickel have the ordered face-centered cubic structure ($\gamma'$ or gamma-prime) have been studied by Josso(1) (1950), Geisler(2) (1953), Viting(3) (1957) and Heumann and Karsten(4) (1963). The single-phase stability field for $\gamma'$ is centered about the composition $FeNi_3$; see FIG. 1. The stability field first appears at approximately 500° C. and broadens to compositions with greater and less nickel with decreasing temperature. The single-phase stability field of $\gamma'$ is separated from the single phase field of disordered face-centered cubic iron-nickel alloys ($\gamma$ or gamma) by a two-phase region of co-existing $\gamma$ and $\gamma'$. At temperatures below 345° C., relatively nickel-poor $\gamma'$ alloy transforms to a two-phase assemblage of $\alpha$ (alpha) iron and $\gamma'$ alloy. This transformation may be inhibited or prevented at low temperatures by slow kinetics.

(1) See footnote (1) at end of specification.
(2) See footnote (2) at end of specification.
(3) See footnote (3) at end of specification.
(4) See footnote (4) at end of specification. stability field boundaries are disputed. Low-temperature data of Heumann and Karsten indicate that the $\gamma'$ field is broad. This result is supported by the high-temperature differential-dilatometry data of Josso as it is interpreted by Geisler. The interpretation of the phase boundaries by Viting, based on electric resistance, microstructure and differential thermal analyses data, shows a much narrower single-phase stability field for $\gamma'$; see FIGS. 1 and 2. At 400° C., the single-phase $\gamma'$ field extends from about 64 to about 83 atomic percent nickel according to the diagram of Heumann and Karsten, whereas the single-phase $\gamma'$ field extends from about 72.5 to about 78 atomic percent nickel according to the results of Viting.

Reported compositions of terrestrial iron-nickel alloys range from 64 to 96 atomic percent nickel, but occurrences of natural, single-phase alloys known to have the $\gamma'$ structure exhibit a more limited range of compositions, supporting the interpretation of Viting of a narrow $\gamma'$ field; see FIG. 3.

The preparation of a wide variety of nickel-iron alloys is known to the art. For instance, U.S. Pat. No. 1,762,730 to McKeehan discloses alloys of nickel and iron which contain 60% to 80% Ni. The alloys are stated to have desirable magnetic characteristics. U.S. Pat. Nos. 4,192,765 and 4,337,167 in the name of John M. Bird et al disclose the use of nickel-iron alloy as a container for radioactive nuclear waste.

OBJECTS OF THE INVENTION

It is an object of the invention to improve the corrosion resistance of industrial metals, especially so-called industrial ferrous metals, by forming a cohesively-bonded coating thereon of an ordered, crystalline synthetic alloy of nickel and iron.

It is another object of the invention to provide industrial products or components thereof from ordered, crystalline, synthetic nickel-iron alloys per se or from industrial metals coated with such synthetic alloys, said industrial products or components having the ability to resist undesirable deterioration in the atmospheric environment, in the marine environment, in the underground environment, or in man-made environments such as concrete, reactors, heat exchangers, boilers, and other corrosive surroundings.

It is a further object of the invention to provide methods for fabricating highly corrosion resistant metals or alloys, coated or otherwise, which are used as materials of construction or as finished products which in their environment of use exhibit enhanced resistance to corrosion.

One or more of the above objects, as well as other objects that will become apparent from consideration of this disclosure, can be achieved by the practice of the invention(s).

THE INVENTION

In a broad aspect, the invention is directed to novel industrial metals, especially industrial ferrous metals, the surface of which is characterized by a coating or bonding of an ordered, crystalline, synthetic alloy of nickel and iron. The resulting novel coated industrial metals have a very long life-time because they exhibit high corrosion resistance (substantially exceeding the corrosion resistance of the industrial metal(s) per se) to a wide variety of chemical and hydrothermal conditions which are generally associated in marine, underground, atmospheric and man-made environments.

Figure 1:
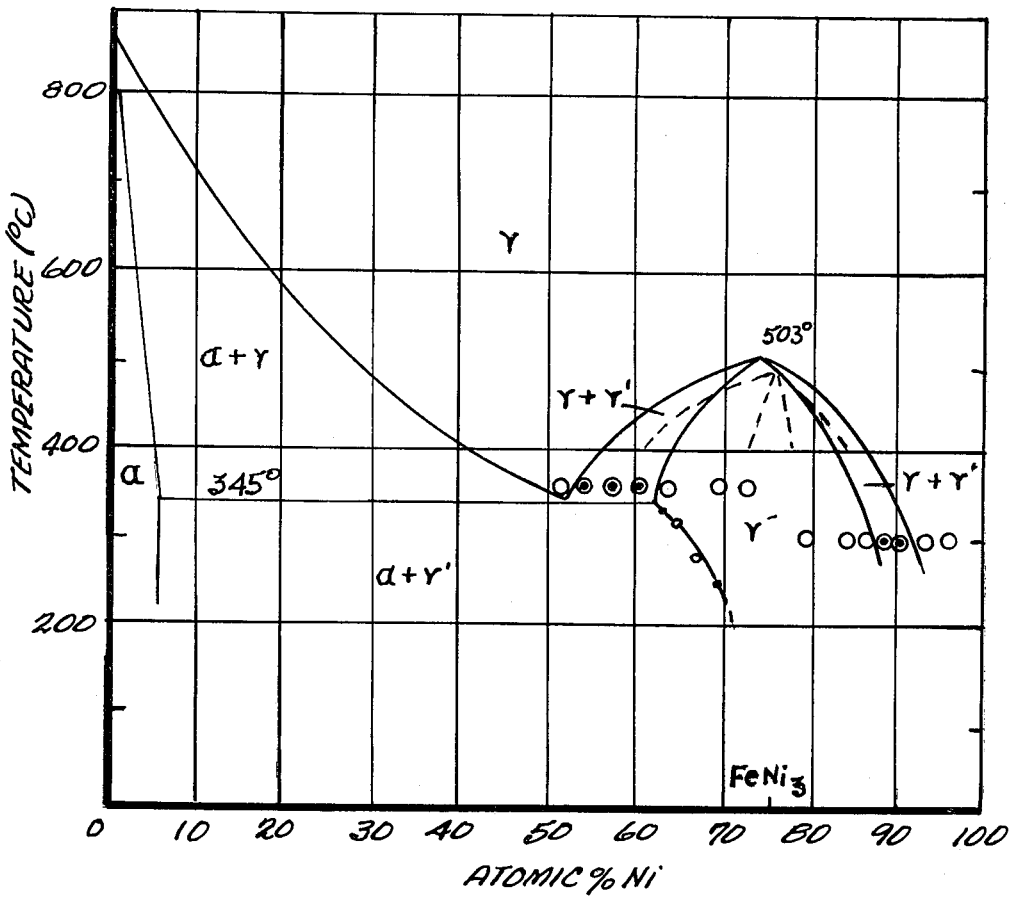
FIG. 1 is a phase diagram of the iron-nickel system between 900° and 200° C.

The ordered, crystalline nickel-iron alloy, while synthetically made, essentially has the properties of the naturally occurring iron-nickel mineral awaruite (produced under thermodynamically stable conditions within serpentine-type rocks) and a composition in the range exhibited by the mineral awaruite. In a broad aspect, the synthetic alloys used in the practice of the invention(s) are within the range which consists essentially of from about 64 to about 83 atomic percent nickel and from about 36 to about 17 atomic percent iron and are within the single-phase $\gamma'$ region of the phase diagram (FIG. 1) of the work by V. T. Heumann and G. Karsten (1963).

Figure 2:
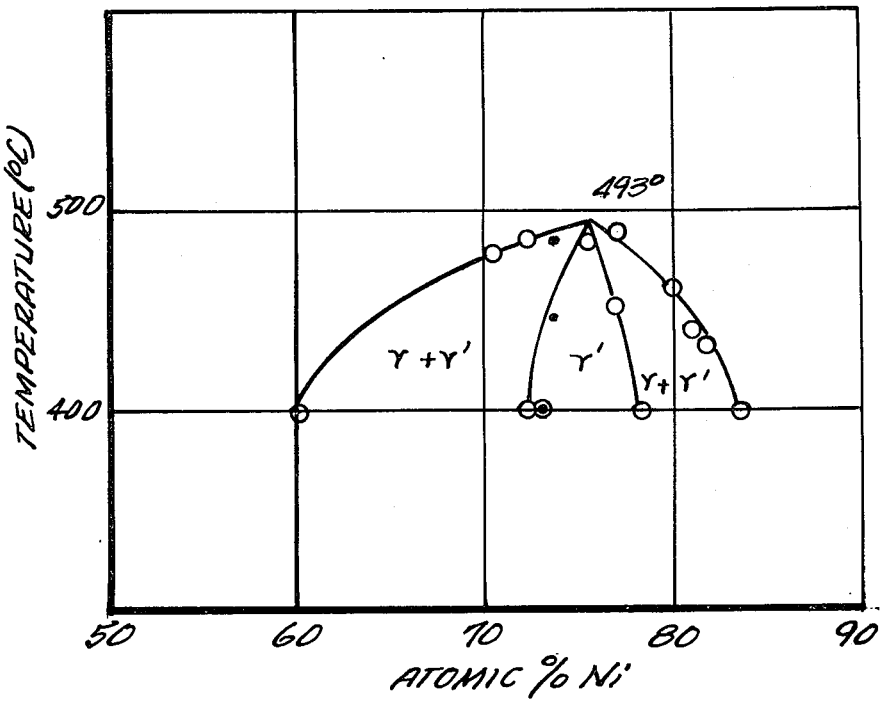
FIG. 2 is the iron-nickel phase diagram in the region $FeNi_3$ according to Viting.
Figure 3:
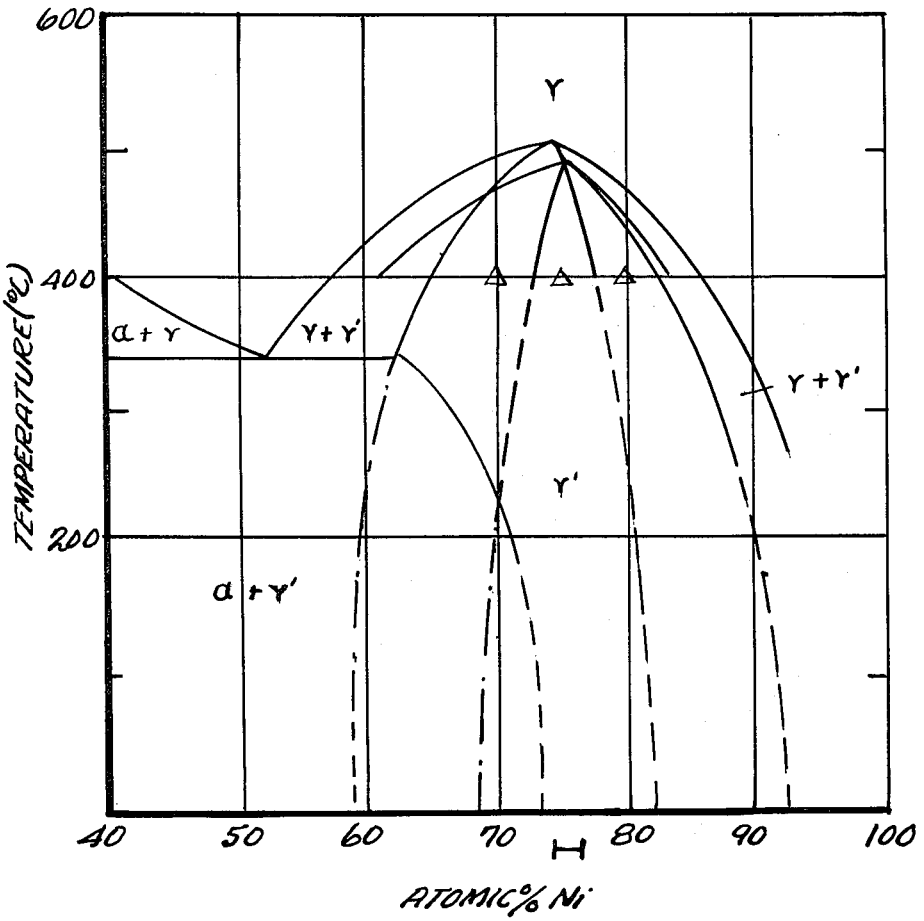
FIG. 3 is an extrapolation of the iron-nickel phase diagrams of Viting and of Heumann and Karsten in the region $FeNi_3$ down to 0° C.

In a preferred aspect, the synthetic alloys are within the range which consists essentially of from about 72.5 to about 78 atomic percent nickel and from about 27.5 to about 22 atomic percent iron and are within the single-phase $\gamma'$ region of the phase diagram (FIG. 2) of the work by L. M. Viting (1957). It is preferred to employ synthetic alloys in which the atomic percent ratio of nickel to iron is approximately 75:25. At this ratio relatively fast cooling rates can be used to bring a melt of $FeNi_3$ to an ordered crystalline state. Small amounts of cobalt or copper, or both, can be contained in the synthetic alloy, e.g., up to about 5 atomic percent cobalt, copper, or mixture of both. Desirably, the synthetic nickel-iron alloy will not contain more than about 2 atomic percent of Co and/or Cu.

The term "corrosion", as used herein, represents the undesirable deterioration of a metal, i.e., an interaction of the metal with its environment which adversely affects those properties of the metal which it is desired to preserve(5).

(5) See footnote (5) at end of specification.

Industrial metals, especially industrial ferrous metals, are used in a great variety of applications, natural and artificial. Thus, the novel highly corrosion resistant coated metals as well as the synthetic nickel-iron alloy per se have wide applicability in marine environments, e.g., aqueous environment such as sea-water and fresh water, underground environments within soil and rock, man-made environments, and atmospheric environments. Illustrative of industrial metal products or components thereof fabricated from the synthetic alloy per se or coated with the synthetic alloy are steam turbine components, boiler tubes, radiators, convertors, heat exchanger components, rivets, buoys, sheets, plates, ship hull components, bearing seals, oil well "Christmas trees", marine and surface piping, signs, antennae, cables, bolts, shafts, propellers, metallic markers and reflectors, towers, bridge components, I-beams, girders, concrete reinforcing bars building panels and other components, components and parts of vehicles, e.g., automobile, train, motorcycle, boat, etc., especially exterior parts such as bumpers, fenders, frames, chassis and other body portions of an automobile. Additionally, such fabricated or coated industrial metal products or components can be used as a material of construction in, for example, drilling rigs, rock mining equipment, paper mills, sulfate processing plants, power plants, petroleum cracking and refining plants, radioactive processing plants, fertilizer plants, diffusion plants, and desalination plants.

By the practice of one aspect of the invention, there are obtained novel coated articles of commerce as illustrated above which are characterized by a higher resistance to corrosion as compared to the corrosion resistance of the corresponding uncoated article of commerce. In preferred aspects of the invention the novel coated article or component is characterized by high corrosion resistance which represents a difference in kind compared to the corrosion resistance of the corresponding uncoated article or component.

The synthetic nickel-iron alloys of the invention are particularly applicable as a coating for the various industrial metals including the well-known metals and alloys of construction, to improve their corrosion resistance in a wide variety of (corrosive) environments illustrated previously. Industrial metals include, in particular, the various so-called ferrous metals, alloys, and other common "metals of construction", e.g., cast iron, steel, etc.

The synthetic nickel-iron alloy can be prepared by melting in a furnace, preferably in an inert atmosphere, a mixture of nickel and iron in the proper proportion, e.g., 75 atomic % Ni and 25 atomic % Fe, followed by slowly cooling the melt. At approximately 500° C. the single-phase $\gamma'$ forms. Slow cooling is continued, preferably with annealing at about 490° C. to 400° C. for several hours, until there is obtained the synthetic ordered $FeNi_3$ alloy at room temperature, e.g., about 20° C.

The synthetic alloy of the invention can be coated on industrial ferrous metals and other metals by various conventional techniques including, for example, hot-dipping, arc-plasma spraying, hot-pressing and rolling, or any other method which does not significantly alter the composition of the $FeNi_3$ alloy. The coating or bonding of the synthetic alloy on the industrial metal substrate greatly enhances the resistance of the metal substrate against the corrosive effects of the various environments illustrated previously. The thickness of such coating or bond on the metal substrate can be in the range of several angstroms to several microns, and thicker, e.g., several mils. In various embodiments the novel product or article may consist essentially of the synthetic Ni-Fe alloy per se.

EXAMPLE

Preparation of Synthetic $FeNi_3$ Alloy

A sample of artificial awaruite was prepared by melting a mixture of 25 weight % Fe and 75 weight % Ni. This melt was produced and cooled in an inert atmosphere in an induction furnace. The melt was cooled slowly to room temperature. An ingot about 1"×3" was produced. Samples of this ingot were used for DebyeScherrer X-ray diffraction analysis and electron microprobe analysis.

Grains about 1 mm in largest dimension of natural awaruite, collected at the "type locality", Awarua Bay, New Zealand (Cornell University collection #25.5-2) were mounted and polished for electron microprobe analysis; similar size grains from the same collection were mounted on a glass fiber for Debye-Scherrer X-ray diffraction analysis; see Table I below.

METHOD

The properties of artificial awaruite that determine its chemical behavior, in comparison with natural awaruite, are dominantly compositional and structural. Since it is known that natural awaruite is very stable in various geologic environments, including surface (oxidizing) and metamorphic (both oxidizing and reducing) conditions[6], the electron microprobe analysis was done to compare the composition and the X-ray diffraction analysis was done to compare the structure of both the natural and artificial specimens of awaruite. For economy purposes, the composition selected for the artificial awaruite was 75 Ni-25 Fe (by weight %).
(6) See footnote (6) at end of specification.

TABLE I

| | Debye-Scherrer X-ray Diffraction d-spacings | | | |
|---|---|---|---|---|
| | Artificial Awaruite | | Natural Awaruite | |
| hkl | $d_{hkl}$ | intensity | $d_{hkl}$ | intensity |
| | 2.25 | weak | 2.25 | weak |
| 111 | 2.04 | intense | 2.04 | intense |
| | 1.955 | very weak | 1.947 | very weak |
| 200 | 1.771 | strong | 1.772 | strong |
| | 1.382 | very weak | 1.382 | very weak |
| 220 | 1.255 | strong | 1.255 | strong |
| | 1.182 | very weak | 1.179 | very weak |
| | 1.131 | very weak | 1.130 | very weak |
| 311 | 1.071 | intense | 1.070 | intense |
| 222 | 1.026 | strong | 1.026 | strong |

FeKα radiation (Fe target/Mn filter)
30 kV 10 mA; $a_o$ = unit cell spacing calculated from d-spacings;
12 hr. exposure; $a_o = 3.55A^o$ The results of the X-ray diffraction analyses on the artificial awaruite (synthetic alloy of $FeNi_3$) and on the natural awaruite (Awarua Bay) establish that they have essentially identical structures, i.e., $FeNi_3$, having an ordered, single-phase (γ′) structure. Other specimens of natural awaruite may and oftentimes do exhibit different proportions of Ni, Fe, and small amounts of additional components. The results of the electron microprobe analyses establish that the artificial awaruite and the natural awaruite have essentially the same chemical composition. Therefore, the behavior of the natural and artificial awaruite in various geochemical environments, and indeed, various "corrosive" environments, would be the same. Various geologic occurrences of natural awaruite demonstrate the remarkable chemical stability of this mineral over very long intervals of time, exceeding millions of years[6]. Artificial awaruite would behave the same as natural awaruite in such various geochemical environments.
(6) See footnote (6) at the end of specification.

Though not economically feasible at the present time, the naturally occurring iron-nickel mineral awaruite can be used in the practice of the invention(s) described herein. The question of economics with respect to the mineral awaruite is dependent mainly on its availability and size of its deposits which are limited at this time.

References to Footnotes (1) Josso, E., 1950, Diagramme d'equilibre de la transformation ordre-desordre dans les ferronickels voisons de $Ni_3Fe$, Comptes Rendus, 230, p. 1467–1469.
(2) Geisler, A. H., 1953, Discussion—the order-disorder transformation viewed as a classical phase change, Trans. Am. Soc. Metals, 45, p. 1051–1054.
(3) Viting, L. M., 1957, Investigation of the iron-nickel-cobalt system in the region of the metallic compounds $Ni_3Fe$ and FeCo: I. The metallic compound $Ni_3Fe$ and the zone of its existance in the iron-nickel system, J. Inorg. Chem., USSR, 2, p. 217–228.
(4) Heumann, V. T., and Karsten, G., 1963, Karbonylverfahren und aufdampfverfahren zur bestimmung von phasengleichgewichten im temperaturbereich geringer beweglichkeit am beispiel der eisen-nickel-legierungen, Archiv Eisenhuttenwesen, 34, 781–785.
(5) Uhlig, H. H. (Ed), 1958, *The Corrosion Handbook.* (Glossary of terms used in corrosion, page xxvi). Inter Society Corrosion Committee Glossary of Terms. *Corrosion.* 14, 319t.
(6) Bird, J. M., Bassett, W. A., and Weathers, M.S., 1979, Widmanstaetten patterns in josephite, a metal-bearing terrestrial rock. Science, 206, p. 832–834; and Bird, J. M. and Weathers, M.S., 1979, Origin of josephinite, Geochemical Journal, Vol. 13, p 41–45.

What is claimed is:

1. A product comprising an industrial metal having a corrosion protective coating of a corrosion resistant synthetic alloy consisting essentially of from about 64 to about 83 atomic % nickel and from about 17 to about 36 atomic % iron, said synthetic alloy having (a) an ordered crystalline structure which is in the single-phase γ′ region of the phase diagram of V. T. Heumann and G. Karsten (FIG. 1), and having (b) essentially the properties of the naturally occurring iron-nickel mineral awaruite.

2. A product according to claim 1 in which the sythetic alloy contains up to about 5 atomic % of copper or cobalt, or mixtures thereof.

3. A product according to claim 2 in which the synthetic alloy contains up to about 2 atomic % of copper or cobalt, or mixtures thereof.

4. A product comprising an industrial metal having a protective coating of a corrosion resistant synthetic alloy consisting essentially of from about 72.5 to about 78 atomic % nickel and from about 27.5 to about 22 atomic % iron, said synthetic alloy having (a) an ordered crystalline structure which is in the single-phase γ′ region of the phase diagram of L. M. Viting (FIG. 2) and having (b) essentially the properties of the naturally occurring iron-nickel mineral awaruite.

5. A product according to claim 4 in which the synthetic alloy contains up to about 5 atomic % of copper or cobalt, or mixtures thereof.

6. A product according to claim 4 in which the synthetic alloy contains up to about 2 atomic % of copper or cobalt, or mixtures thereof.

7. A product according to claim 4 in which the atomic percent ratio of nickel to iron is 75:25.

8. A product according to claim 7 in which the synthetic alloy contains up to about 5 atomic % of copper or cobalt, or mixtures thereof.

9. A product according to claim 7 in which the synthetic alloy contains up to about 2 atomic % of copper or cobalt, or mixtures thereof.

10. The product of claim 1, 4 or 7 wherein said industrial metal is an industrial ferrous metal.

11. A product according to claim 1 in an environment normally corrosive to said industrial metal, said product having increased resistance to corrosion by the environment due to the coating of said synthetic alloy.

12. A product according to claim 4 in an environment normally corrosive to said industrial metal, said product having increased resistance to corrosion by the environment due to the coating of said synthetic alloy.

13. A product according to claim 7 in an environment normally corrosive to said industrial metal, said product having increased resistance to corrosion by the environment due to the coating of said synthetic alloy.

14. A product according to claim 12 in which said environment is a marine environment.

15. A product according to claim 12 in which said environment is an underground environment.

16. A product according to claim 12 in which said environment is an atmospheric environment.

17. A product according to claim 12 in which said environment is a man-made environment.

18. As an article of manufacture, a product according to claim 4 or 12 in which the coated industrial metal is in the form of a surface, underwater, or underground pipe.

19. As an article of manufacture, a product according to claim 4 or 12 in which the coated industrial metal is in the form of cable.

20. As an article of manufacture, a product according to claim 4 or 12 in which the coated industrial metal is in the form of a plate or sheet.

21. As an article of manufacture, a product according to claim 4 or 12 in which the coated industrial metal is in the form of a component for exterior parts of a vehicle.

22. Articles of manufacture according to claim 18 in which the atomic percent ratio of nickel to iron is 75:25.

23. A product comprising an industrial metal having a corrosion protective coating of naturally occurring, ordered, iron-nickel mineral awaruite which consists essentially of from about 64 to about 83 atomic % nickel and from about 17 to about 36 atomic % iron.

24. A product according to claim 23 in which said mineral awaruite consists essentially of from about 72.5 to about 78 atomic % nickel and from about 27.5 to about 22 atomic % iron.

25. A product according to claim 23 or 24 in which said mineral awaruite contains up to about 5 atomic % copper or cobalt, or mixtures thereof.

* * * * *

UNITED STATES PATENT AND TRADEMARK OFFICE

CERTIFICATE OF CORRECTION

PATENT NO. : 4,433,033

DATED : February 21, 1984

INVENTOR(S) : John Bird

It is certified that error appears in the above-identified patent and that said Letters Patent is hereby corrected as shown below:

Column 2, line 9, (i.e. lines in small print beginning (4) there has been omitted before "stability" the language "The positions of the $\gamma + \gamma'$ and single-phase $\gamma'$". Also, everything beginning with this added material and continuing through line 16 in small print actually should be in normal size print since it is not a part of the footnote.

Signed and Sealed this

*Twelfth* Day of *June 1984*

[SEAL]

*Attest:*

GERALD J. MOSSINGHOFF

*Attesting Officer*

*Commissioner of Patents and Trademarks*